United States Patent [19]

Eheim

[11] 4,205,645

[45] Jun. 3, 1980

[54] APPARATUS FOR SUPPLEMENTARY CONTROL OF A COMBUSTIBLE MIXTURE

[75] Inventor: Franz Eheim, Stuttgart, Fed. Rep. of Germany

[73] Assignee: Robert Bosch GmbH, Stuttgart, Fed. Rep. of Germany

[21] Appl. No.: 934,115

[22] Filed: Aug. 16, 1978

[30] Foreign Application Priority Data

Sep. 16, 1977 [DE] Fed. Rep. of Germany ..... 2741834

[51] Int. Cl.[2] ..... F02M 25/06; F02M 7/00

[52] U.S. Cl. ..... 123/119 A; 123/139 AW; 123/139 BG

[58] Field of Search ..... 123/139 AW, 139 BG, 123/140 FG, 119 A

[56] References Cited

U.S. PATENT DOCUMENTS

| | | | |
|---|---|---|---|
| 2,950,095 | 8/1960 | Nystrom et al. | 123/139 AW |
| 3,951,120 | 4/1976 | Schlott | 123/139 AW |
| 4,031,873 | 6/1977 | Banzhaf et al. | 123/139 AW |
| 4,043,304 | 8/1977 | Stumpp et al. | 123/32 R |
| 4,143,631 | 3/1979 | Stumpp | 123/139 BG |

*Primary Examiner*—Charles J. Myhre
*Assistant Examiner*—Magdalen Moy
*Attorney, Agent, or Firm*—Edwin E. Greigg

[57] ABSTRACT

A fuel control device for an internal combustion engine employing a fuel mixture preparation system in which the amount of fuel is set at will and the amount of combustion air is adjusted automatically. In order to provide sufficient air during abrupt and rapid actuations of the fuel control lever, there is provided a hydraulic differentiating mechanism which senses rapid displacements of the fuel control lever and which temporarily opens a channel leading from a source of high hydraulic pressure directly to the servo motor that pivots the air throttle, thereby causing additional opening of the air throttle and an increased rate of air flow. The high pressure channel is closed gradually after the occurrence of the abrupt fuel change.

6 Claims, 1 Drawing Figure

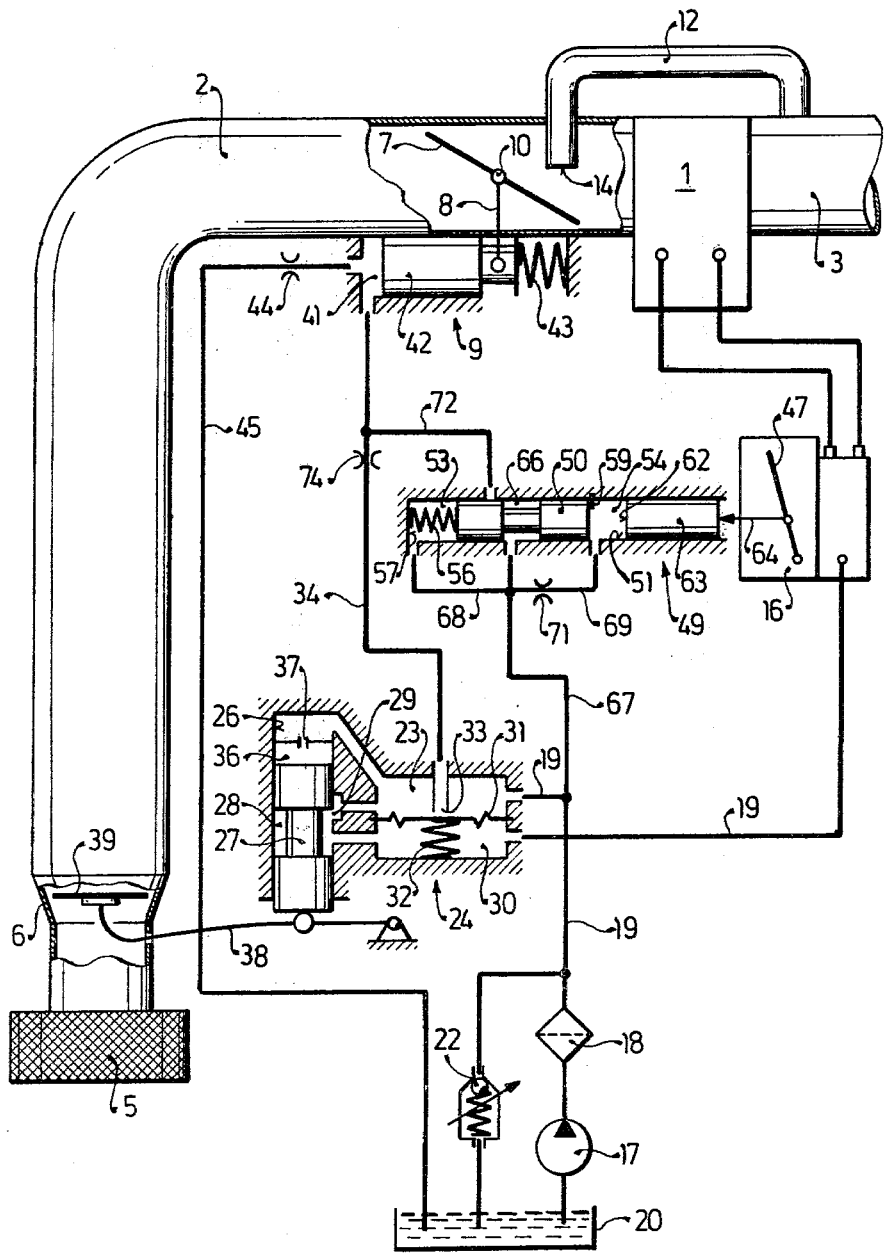
12
2
7
10
14
1
8
3
44
41
42
9
43
72
47
45
74
53
66
50
59
54
62
57
56
51
63
64
34
68
71
69
49
16
37
29
67
26
23
33
31
36
19
28
19
27
39
32
24
30
6
38
19
22
18
5
17
20

APPARATUS FOR SUPPLEMENTARY CONTROL OF A COMBUSTIBLE MIXTURE

BACKGROUND OF THE INVENTION

The invention relates generally to the fuel management of an internal combustion engine. More particularly, the invention relates to an engine equipped with a fuel metering system and including an arbitrarily settable fuel injection mechanism as well as an automatically adjusted air throttle in the induction tube. The fuel supply system to which the invention specifically relates includes an air flow rate meter which is displaced by the air flowing through the induction tube and which controls the position of the air throttle on the basis of information related to the actual fuel flow to the engine. In the known fuel supply system to which this invention relates, the displacement of the air flow throttle is so slow that it is unable to follow rapid displacements of the fuel control member in the fuel metering system so that a sudden displacement of the control member may cause temporary excessive enrichment of the fuel-air mixture.

OBJECT AND SUMMARY OF THE INVENTION

It is a principal object of the invention to provide an improvement to the known fuel management system described above in which the aforementioned disadvantage is prevented, i.e., in which the air flow throttle plate is capable of rapid adjustments to compensate for equally rapid actuation of the fuel control member. This object is attained according to the invention by providing a hydraulic differentiating device which is coupled to the fuel control member of the fuel metering system and which, when actuated sufficiently rapidly, will cause a short term communication of the pressure chamber in the servo motor which displaces the air throttle with a source of maximum system pressure. The resulting short term displacement of the servo motor and the air throttle prevents the temporary excessive enrichment of the operational mixture and the smoke generation which would take place when the fuel control member is actuated very abruptly.

It is thus a feature of the improvement provided by the present invention that the closed hydromechanical control loop is temporarily overridden when the rapidity of actuation of the arbitrarily set fuel control member exceeds a given value. In that case, the closed-loop control effort to restore equilibrium is assisted by a short term increase of the servo pressure which adjusts the position of the air flow throttle valve and thus temporarily provides an open-loop control characteristic. The apparatus of the invention provides an automatic transition from this uncontrolled assist to the normal closed control characteristics by a gradual decay of the excess pressure in the servo motor. The apparatus of the invention thus provides a sufficient amount of fresh air even for extremely rapid increases of the fuel supplied to the engine while nevertheless maintaining the relatively slow and stable closed-loop control of the balance between air flow and fuel and a concurrent control of the exhaust gas recycle rate, in all operational domains of the engine.

The invention will be better understood as well as further objects and advantages thereof become more apparent from the ensuing detailed description of a preferred exemplary embodiment taken in conjunction with the drawing.

BRIEF DESCRIPTION OF THE DRAWING

The single FIGURE of the drawing is a partially sectional and schematic illustration of a fuel management system according to the present invention.

DESCRIPTION OF THE PREFERRED EMBODIMENT

Turning now to the single FIGURE, there will be seen a highly schematic representation of an internal combustion engine 1 provided with an air induction tube 2 and an exhaust gas manifold 3. The inlet of the induction tube 2 is closed by an air filter 5 downstream of which the induction tube is profiled in the manner of an air funnel 6 of increasing diameter. Downstream of the air funnel 6, there is disposed within the induction tube a pivotable throttle plate 7 which may be rotated by linkage 8 coupled to a hydraulic servo motor 9. Downstream of the pivotal shaft 10 of the throttle plate 7, the induction tube supports the terminus 14 of an exhaust gas recycle line 12 which is so located that the throttle plate 7 closes off the outlet 14 of the exhaust gas recycle line 12 when it is fully opened to permit maximum air flow.

The internal combustion engine is supplied with fuel in known manner by a known fuel injection pump 16 which may be, as illustrated in the figure, a known serial injection pump, but may also be a distributing injection pump or, again, a suction throttle injection pump. A fuel supply pump 17 pumps fuel from a reservoir 20 through a fuel filter 18 to the fuel injection pump 16 at a selectable and essentially constant pressure regulated by a pressure control valve 22. The pressure which is provided by the pressure control valve 22 may be adjusted on the basis of air pressure or temperature or some other variable in a known manner, not further illustrated.

The fuel supply system also includes a differential pressure valve 24 divided into two chambers by a diaphragm 31. A branch of the fuel supply line 19 is fed through the controlled pressure chamber 23 of the differential pressure valve 24 and is continued therefrom into the cylinder bore 26 of a fuel control valve which includes a spool valve member 27 having an annular control groove 28. Depending on the axial position of the spool valve 27, a variable metering cross section 29 is opened in the fuel supply line 19. Downstream of the metering cross section 29, fuel flows freely through the uncontrolled pressure chamber 30 of the differential pressure valve 24 and continues through the fuel supply line 19 to the inlet of the fuel injection pump 16. The pressure chambers 23 and 30 are separated by a flexible diaphragm 31 and a spring 32 located in the chamber 30 provides biasing pressure tending to push the diaphragm 31 against the valve seat 33 at the end of a fuel relief line 34. The relative position of the diaphragm 31 and the valve seat 33 determine the amount of fuel which may flow through the relief line 34.

The space 36 defined by the end face of the spool valve 27 and the guide bore 26 is coupled through a fixed throttle 37 to the fuel supply line 19 upstream of the metering cross section 29. Accordingly, the face of the spool valve 27 experiences the substantially constant and regulated fuel pressure in the fuel supply line 19 upstream of the metering cross section which urges the spool valve 27 to move axially in the direction of a pivotal arm 38, one end of which is pivotably mounted in a low friction bearing and the other end of which carries a baffle plate 39 which lies athwart the induction tube. When the engine is running, the baffle plate 39 is displaced by the differential pressure in opposition to the substantially constant restoring force provided by fuel pressure and exerted against the face of the spool valve 27. By suitably adjusting the profile of the air funnel 6, the functional relationship between the increasing annular opening defined by the edge of the baffle plate 39 and the surrounding wall of the induction tube 2 with respect to the displacement of the baffle plate 39 may be made nonlinear. Similarly, for example, the slotted configuration of the metering cross section 29 may provide a linear relationship between the fuel flow cross section and the displacement of the spool valve 27. By combination of these two effects, together with a constant restoring force on the spool valve 27 and hence on the baffle plate 39, the desired air-fuel ratio may be obtained in various operational domains of the engine for a constant pressure difference across the metering cross section 29.

The relief line 34 passes through the pressure chamber 41 of a servo motor 9 which is embodied in the present example as a piston 42 moving axially against the force of a compression spring 43. The piston 42, which could also be embodied, for example, as a diaphragm, is coupled to a linkage 8 which serves to rotate the air throttle 7. The pressure chamber 41 is further connected via a fixed throttle 44 and a return line 45 to the fuel container 20.

The apparatus described above functions in the following manner. Let it be assumed that, beginning with an equilibrium state of the system, the amount of fuel supplied to the engine is increased by a movement of the fuel control lever 47. If the position of the spool valve 27 is assumed to be unchanged in the first instant, the movement of the lever 47 will have caused a decrease of pressure in the line 19 and hence in the pressure chamber 30 of the differential pressure valve 24. It is the function of the differential pressure valve 24 to continuously compare the amount of fuel actually supplied to the engine with the air flowing through the induction tube. The decrease of pressure in the chamber 30 now causes an excursion of the diaphragm 31 away from the valve seat 33, thus increasing the flow of fuel through the relief line 34. The increased flow through the relief line 34, which may be regarded as a control deviation or control error, increases the pressure in the chamber 41 of the servo motor 9, thereby causing the piston 42 to move against the force of the spring 43 and to tend to open the throttle plate 7 further. The rotation of the throttle plate 7 causes an increase of the air flow through the induction tube 2 and, at the same time, a reduction of the amount of gas admitted from the exhaust gas recycle conduit 12. As a result of the increasing air flow rate through the induction tube 2, the baffle plate 39 experiences an excursion tending to increase the free annular aperture in the funnel 6 until such time as the lever 38 experiences an equilibrium of forces. The events just described will take place in the opposite relative direction when the lever 47 is moved in the sense of decreasing the amount of fuel supplied to the engine. The system described so far constitutes a closed hydraulic control loop for continuously adjusting the amount of fresh air supplied to the engine to the amount of fuel actually delivered and, in addition, to provide an optimum amount of recycled gases so as to maintain full power in all operational domains, including that of full-load, when the throttle plate 7 is fully opened and the exhaust gas recycle rate is reduced to zero. It is a distinct advantage of the apparatus described above that the fuel metering and measurement takes place externally of the fuel injection pump in which it would be subject to many disturbing influences. Nevertheless, it is possible to provide any desired amount of acceleration by direct actuation of the fuel control lever 47.

The above-described system permits a continuous and oscillation-free closed loop control of the air-fuel ratio. However, the displacement of the throttle plate 7 as a result of changes in the fuel flow proceeds relatively slowly. As a result, when the amount of fuel supplied to the engine undergoes rapid changes, the throttle plate 7 may be unable to follow these changes and may cause a short-term excessive enrichment of the operational mixture, especially if the engine is operated close to the smoke limit.

It is thus a particular feature of the present invention to provide, in addition to the apparatus described above, a mechanism 49 which takes account of the rapidity with which the fuel control member of the fuel control metering system or the injection pump is displaced. This mechanism includes a control piston 50 which moves within a closed cylinder 51 in which it defines a first pressure chamber 53 and a second pressure chamber 54, respectively located at opposite ends of the control piston 50. A compression spring 56 located in the first pressure chamber 53 is supported by the bottom of the cylinder 51 and urges the piston 50 against a fixed stop 59 which constitutes its normal position. The second pressure chamber 54 is variably defined by the face 62 of a movable auxiliary piston 63 which may be displaced axially by the fuel control lever 47 with which it is coupled through a linkage 64.

The control piston 50 has an annular groove 66 which communicates permanently and independently of the position of the piston 50 with the system pressure upstream of the differential pressure valve 24 via a line 67. Branching off from the line 67 is a line 68 leading to the first pressure chamber 53 and a second line 69 leading to the second pressure chamber 54, the line 69 containing a second throttle 71. Further branching off from the cylinder 51 is a pressure line 72 which is connected to the aforementioned pressure chamber 41 of the servo motor 9 via the existing relief line 34. In the normal position of the piston 50 against its stop 59, the line 72 is blocked off and is variably opened by an axial displacement of the piston 50 in opposition to the force of the spring 56. A third throttle 74 is provided in the relief line 34 upstream of the terminus of the pressure line 72.

The mechanism 49 described above serves as a differentiating device for detecting the speeds with which the fuel control member is displaced. In the normal position of the control piston 50 against its stop, the pressures in the first and second pressure chambers 53,54 are equal to the constant system pressure supplied by the pump 17. The same pressure holds the auxiliary piston 63 in contact with the actuating linkage 64. The pistons are fitted within the cylinder 51 so as to prevent any substantial leakage. The function of the piston 50 may also be assumed, for example, by a flexible diaphragm. If the fuel control member, i.e., the lever 47, is rapidly moved to the left of the figure, i.e., in the direction of an increased amount of fuel, the piston 63 is displaced axially to the left and displaces an amount of fuel which could be fed into the system via the throttle 71. However, the presence of the throttle 71 prevents the totality of the fuel flow due to the motion of the piston 63 from passing through the channel 69 and causes instead an axial displacement of the piston 50 when the volume displaced per unit time by the piston 63 exceeds a certain value. The motion of the piston 50 eventually opens the path between the annular groove 66 and the line 72, thereby permitting system fuel pressure to reach the servo chamber 41. The end face of the piston 42 is thus exposed to the uncontrolled maximum system pressure and undergoes a rapid displacement to the right as seen in the figure, against the forces of the spring 43, thereby causing a further opening displacement of the throttle plate 7. Once the leftward motion of the lever 47 ceases, the temporarily increased pressure in the second pressure chamber 54 decays via the throttle 71, thereby permitting the control piston 50 to return to its stop 59 in which position the line 72 is closed again. The temporarily increased pressure in the servo chamber 41 decays via the first throttle 44 until it is equal to the pressure controlled by the differential pressure valve 24. At that time, the throttle plate 7 also reassumes its normal, controlled position.

In the manner described above, an abrupt movement of the fuel control lever to supply an increased amount of fuel tends to open the throttle plate 7 to permit an increased amount of fresh air and to prevent a temporary excessive enrichment of the fuel-air mixture.

The magnitude of uncontrolled displacement and the time of occurrence of such a displacement provided by the mechanism 49 may be selected by suitable dimensioning of the second throttle 71 and the size of the end face 62 as well as by suitable choice of the position of the branching point of the line 72. A further factor affecting the operation of the mechanism 49 is the characteristic of the compression spring 56. The third throttle 74 may be provided to prevent a coupling effect onto the differential pressure valve 24.

The second branch line 69 which is shown in the figure as an external line may also be embodied as a bore within the body of the cylinder 51 leading from the pressure chamber 54 to the annular groove 66.

The foregoing relates to a preferred exemplary embodiment of the invention, it being understood that other embodiments and variants thereof are possible within the spirit and scope of the invention.

What is claimed and desired to be secured by Letters Patent of the United States is:

1. An apparatus for controlling the composition of the combustible mixture for an internal combustion engine having an induction tube including an air valve in said induction tube, an exhaust gas recycle line for delivering exhaust gas to said induction tube, a fuel metering device which can be adjusted at will, air flow rate measuring means, comparison means for comparing the fuel flow rate with the air flow rate and for controlling said air valve in said induction tube so as to maintain desired fuel-air ratios, and to vary the delivery quantity of fed-back exhaust gas into said induction tube in a complementary manner thereto a hydraulic servo motor for actuating said air valve, said servo motor having an actuation chamber coupled hydraulically to said comparison means to receive actuating pressure therefrom and velocity detector means, for detecting the velocity of adjustment of said fuel metering device and for altering the actuation pressure for said servo motor in dependence on said velocity of adjustment.

2. An apparatus according to claim 1, wherein said velocity detector means comprises a differentiating device for generating an output signal related to the time derivative of a mechanical displacement taking place during adjustment of said fuel metering device.

3. An apparatus according to claim 2, wherein said differentiating device comprises a hydraulically operating device.

4. As apparatus according to claim 3, wherein said velocity detector means includes a cylinder, a fixed stop disposed in said cylinder, a control piston displaceable axially in said cylinder, one face of which defines with the end of said cylinder a first pressure chamber, a spring disposed in said first pressure chamber urging said control piston against said fixed stop and coming into contact with the face of said control piston remote from said spring, said cylinder further including a movable wall displaceable by said fuel metering device and defining with an end face of said control piston a second pressure chamber, said control piston having an annular section of reduced diameter defining a space, a first line for communicating said space with said first pressure chamber at all times and a second line containing a flow throttle for communicating said space with said second pressure chamber at all times, said cylinder having an orifice, a third line for connecting said orifice to said actuation chamber of said servo motor via said third line, said orifice being variably openable by axial motions of said control piston.

5. An apparatus according to claim 4, including a line for conducting actuation pressure from said comparison means to the actuation chamber of said servo motor, a source of zero pressure means including a flow throttle for connecting said actuation chamber to said source of zero gage pressure and a return line.

6. An apparatus according to claim 4, including a line for connecting said comparison means to said actuation chamber of said servo motor and having a flow throttle disposed therein at a point upstream of the terminus of said line connecting said orifice to said actuation chamber of the servo motor.

* * * * *